US005273469A

United States Patent [19]

Lueschen et al.

[11] Patent Number: 5,273,469

[45] Date of Patent: Dec. 28, 1993

[54] COMPOSITE SWIM FIN WITH CANTILEVERED HEEL

[76] Inventors: Jeffrey D. Lueschen, 2335 Caringa Way #23, Carlsbad, Calif. 92009; Peppo Biscarini, 814 Nardo Rd., Encinitas, Calif. 92024

[21] Appl. No.: 847,950

[22] Filed: Mar. 6, 1992

[51] Int. Cl.[5] ..... A63B 31/08

[52] U.S. Cl. ..... 441/64; 441/61

[58] Field of Search ..... 441/61-64, 441/55, 56, 59, 65, 68, 73, 76; 9/309, 304, 305, 308; 425/129; D21/238, 239

[56] References Cited

U.S. PATENT DOCUMENTS

| | | | |
|---|---|---|---|
| 3,922,741 | 12/1975 | Semeia | 441/64 |
| 4,083,071 | 4/1978 | Forjot | 441/64 |
| 4,940,437 | 7/1990 | Piatt | 441/64 |
| 4,954,111 | 9/1990 | Cressi | 441/64 |

FOREIGN PATENT DOCUMENTS

| | | | |
|---|---|---|---|
| 819804 | 11/1951 | Fed. Rep. of Germany | 441/64 |
| 2543004 | 9/1984 | France | 441/64 |
| 0738626 | 6/1980 | U.S.S.R. | 441/64 |

*Primary Examiner*—Edwin L. Swinehart

[57] ABSTRACT

A composite swim fin with a cantilevered heel. The cantilevered heel acts as a structural member extending to and beneath the swimmer's heel to counteract the flexure of the swim fin blade during the most powerful downward kick, This type of loading on the heel of the foot replicates the natural loading incurred on the heel of the foot during walking and reduces uncomfortable stress concentrations that might otherwise occur upon the swimmer's foot.

15 Claims, 2 Drawing Sheets

COMPOSITE SWIM FIN WITH CANTILEVERED HEEL

BACKGROUND—FIELD OF INVENTION

This invention relates to a swim fin made of two different materials, specifically a soft ductile material for the shoe and a hard stiff material for the blade.

BACKGROUND—DESCRIPTION OF PRIOR ART

Swim fins made of composite materials are known. Shoes are made of a soft ductile material for user comfort. Blades are made of a hard stiff resilient material to provide flexure required for propulsion. Some swim fins have blades that extend to the heel of the shoe and arch over the front part of the shoe. Such an arrangement is disclosed, for example, in Cressi U.S. Pat. No. 4,954,111. Another such arrangement is disclosed in European Pat. No. EP-0-310-828-A2 to Semeia. In both of these swim fins, the blades extend to the heel of the shoe and arch over the front top part of the shoe to contain the shoe in a rigid manner. Since it is contemplated that the swim fin is a devise of flexure, rigid containment of the swimmer's foot may produce excessive and uncomfortable stress concentrations upon the swimmer's foot.

OBJECTS AND ADVANTAGES

Human anatomy is adapted for walking upright and forward. The human foot is adapted to receiving the entire load from the weight of the body upon the bottom of the foot. Muscle groups in the leg, adapted to walking forward, are able to kick forward with more power than they are able to kick in reverse.

Accordingly, several objects and advantages of the present invention are;

(a) to provide a swim fin that loads the bottom of the foot as a result of kicking upwards or downwards, (b) to provide a swim fin that reduces excessive and uncomfortable stress concentrations upon the swimmer's foot, (c) to provide a swim fin that utilizes the asymmetrical kicking power of the leg.

Further objects and advantages will become apparent upon a reading of the entire specification, including the drawing and claims.

DRAWINGS FIGURES

REFERENCE NUMERALS AND LETTERS IN DRAWINGS

Figure 1:
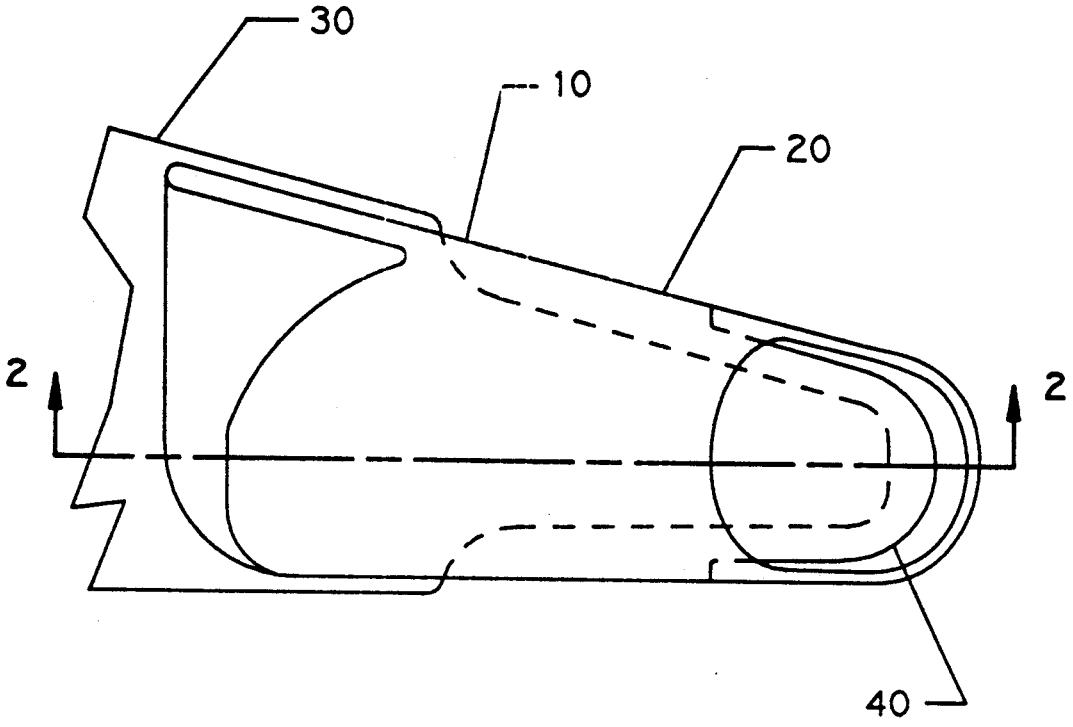
FIG. 1 is a plan view of the present invention.

10: swim fin
20 shoe
30 blade
40 cantilevered heel
50 foot
60 instep of the foot
70 heel of the foot
80 pivot point
F1 applied downward force
R1 downward reactive resistive force
T1 clockwise torque
R2 downward reactive force
F2 applied upward force
R3 upward reactive resistive force
T2 counterclockwise torque

Figure 2:
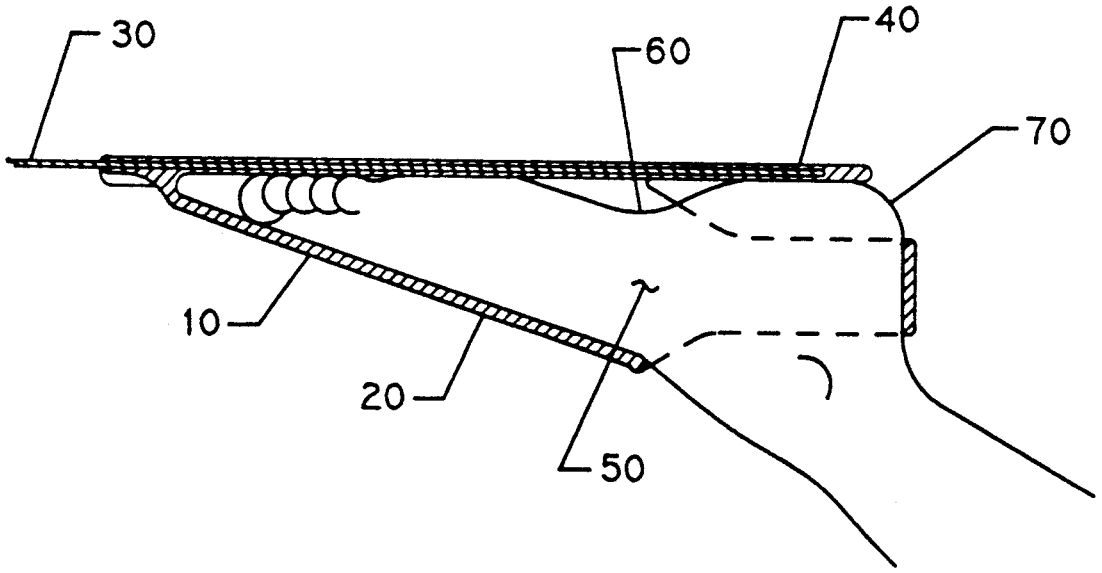
FIG. 2 is a section view of the present invention taken along section line 2—2.

DESCRIPTION—FIGS. 1 to 2

A typical embodiment of the present invention 10 is shown in FIGS. 1 and 2. FIG. 1 illustrates a shoe 20 with the blade 30 extending to and joining the cantilevered heel 40 from a plan view. FIG. 1 illustrates the present invention 10 with a foot 50 positioned within the shoe 20. The cantilevered heel 40 is comprised of both the blade 30 and the shoe 20 and extends from the instep of the foot 60 to and beneath the heel of the foot 70.

Figure 3:
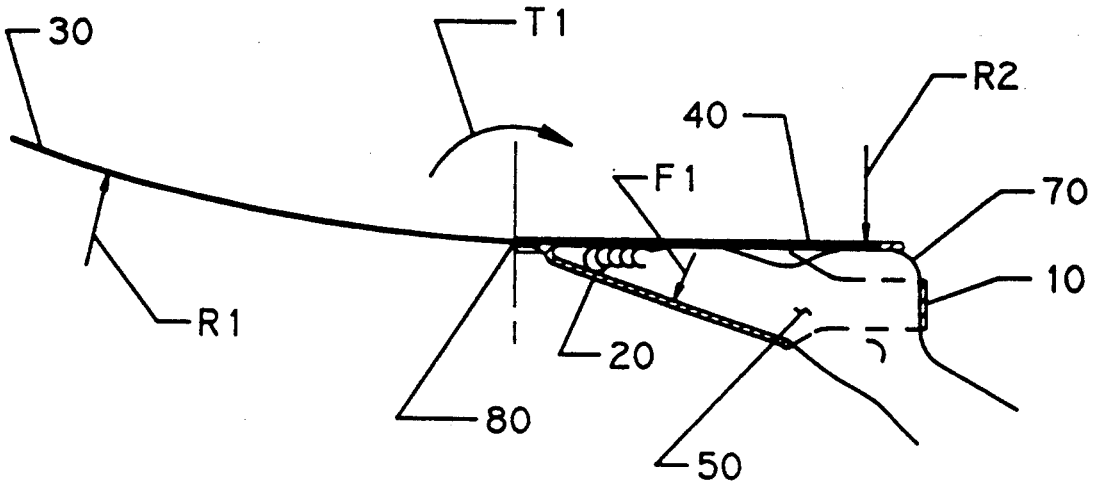
FIG. 3 is a pictorial elevation view of the present invention in use by a swimmer depicting applied and reactive forces that occur during the downward power stroke.
Figure 4:
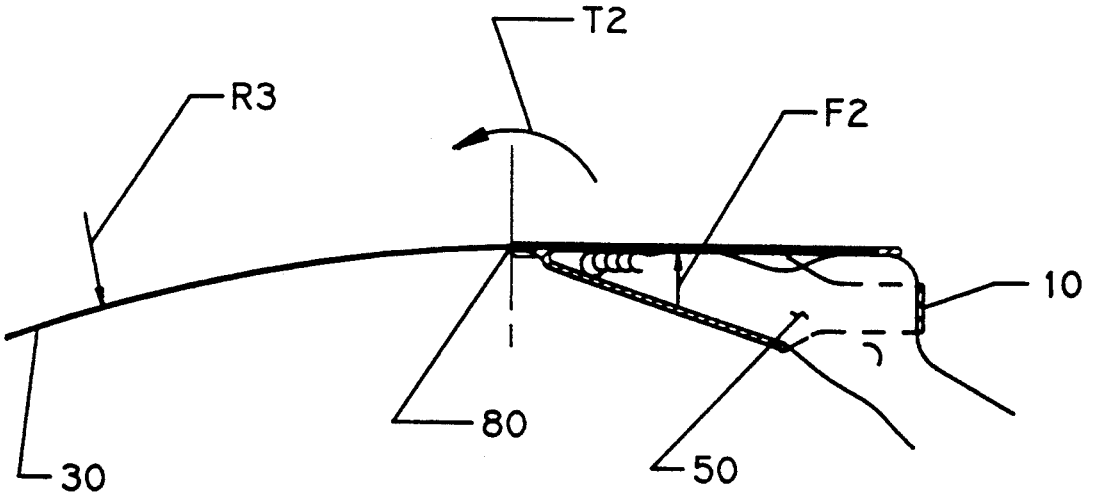
FIG. 4 is a pictorial elevation view of the present invention in use by a swimmer depicting applied and reactive forces that occur during the upward return stroke.

OPERATION FIGS. 3 to 4

The applied and reactive forces incurred during the most powerful stroke, the downward stroke, are shown in FIG. 3. The swim fin 10 moves in a downward direction due to the applied downward force PI applied at the top of the foot cavity of the shoe 20 by the foot 50. A downward reactive resistive force Ri is created upon the blade 30 as it moves through the water thereby creating a clockwise torque T1 about pivot point 80. The clockwise torque T1 induces a downward reactive force R2 upon the heel of the foot 70. This type of loading on the heel of the foot 70 replicates the natural loading incurred on the heel of the foot 70 during walking. The cantilevered heel 40 acts as a flexure counteracting the flexure of the blade 30 induced by the downward reactive resistive force R1. The cantilevered heel 40 on the shoe 20 provides an additional lever arm length to counter the clockwise torque T1. This allows for a greater power transmission from the swimmer to the swim fin 10 during the downward stroke without inducing excessive and uncomfortable stress concentrations upon the swimmer's foot 50.

The applied and reactive forces incurred during the return stroke, the upward stroke, are shown in FIG. 4. The swim fin 10 moves in the upward direction, due to the applied upward force F2 applied beneath the toes of the foot 50 by the foot 50. A reactive resistive force R3 is created upon the blade 30 as it moves through the water thereby creating a counterclockwise torque T2. This type of loading primarily loads the toes and the forward bottom area of the foot 50 replicating the loading incurred on the foot 50 during walking.

SUMMARY, RAMIFICATIONS, AND SCOPE

Accordingly, the reader will see that the composite swim fin with cantilevered heel provides a natural loading to the bottom of the swimmer's foot. Utilization of the leg's muscle groups is achieved by making the downward stroke the most powerful stroke.

It will be recognized that modifications may be made within the scope of the invention, and this invention is not restricted to the preferred embodiment illustrated. The scope of the invention should be determined by the appended claims and their legal equivalents, rather than by the examples given.

We claim:

1. A composite swim fin which comprises in combination:

(a) a hard stiff resilient and normally planar fin blade that extends to and beneath the heel of a foot;

(b) a shoe having an upper and an outer and inner sole that extends to and beneath the heel of said foot, said fin blade being positioned intermediate said inner and outer sole; and (c) an assembly of said blade and said outer and inner sole which results in a cantilevered heel which extends unattached to said foot from the instep to and beneath the heel of the foot.

2. The composite swim fin according to claim 1 wherein the heel area of said shoe is open.

3. The composite swim fin according to claim 1 wherein said foot is retained in said shoe by a strip.

4. The composite swim fin according to claim 1 wherein said shoe is composed of a soft ductile material relative to said blade.

5. The composite swim fin according to claim 1 wherein said blade is composed of a hard stiff material relative to said shoe.

6. A composite swim fin which comprises in combination:

(a) a hard stiff resilient and normally planar fin blade that extends to and beneath the heel of a foot;

(b) a shoe having an upper and an outer and inner sole that extends to and beneath the heel of said foot; and (c) an assembly of said blade and said shoe wherein said blade defines the outer sole of said shoe resulting in a cantilevered heel which extends unattached to said foot from the instep to beneath the heel of the foot.

7. The composite swim fin according to claim 6 wherein the heel area of said shoe is open.

8. The composite swim fin according to claim 6 wherein said foot is retained in said shoe by a strap.

9. The composite swim fin according to claim 6 wherein said shoe is composed of a soft ductile material relative to said blade.

10. The composite swim fin according to claim 6 wherein said blade is composed of a hard stiff material relative to said shoe.

11. A composite swim fin which comprises in combination:

(a) a hard stiff resilient and normally planar fin blade that extends to and beneath the heel of a foot;

(b) a shoe having an upper and a sole having inner and outer surfaces that extends to and beneath the heel of said foot; and (c) an assembly of said blade and said shoe wherein said blade is fitted into correspondingly shaped recess formed in the thickness of the sole of said shoe between said inner and outer surfaces resulting in a cantilevered heel which extends unattached to said foot from the instep to and beneath the heel of the foot.

12. The composite swim fin according to claim 11 wherein the heel area of said shoe is open.

13. The composite swim fin according to claim 6 wherein said foot is retained in said shoe by a strap.

14. The composite swim fin according to claim 6 wherein said shoe is composed of a soft ductile material relative to said blade.

15. The composite swim fin according to claim 6 wherein said blade is composed of a hard stiff material relative to said shoe.

* * * * *